US012006179B2

(12) United States Patent
Takano et al.

(10) Patent No.: US 12,006,179 B2
(45) Date of Patent: Jun. 11, 2024

(54) RECORDING APPARATUS

(71) Applicant: CANON KABUSHIKI KAISHA, Tokyo (JP)

(72) Inventors: Ryo Takano, Kanagawa (JP); Tetsu Hamano, Tokyo (JP); Atsushi Ikeda, Kanagawa (JP); Masaaki Ishihara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 160 days.

(21) Appl. No.: 17/859,506

(22) Filed: Jul. 7, 2022

(65) Prior Publication Data

US 2023/0029136 A1 Jan. 26, 2023

(30) Foreign Application Priority Data

Jul. 19, 2021 (JP) ..... 2021-118807

(51) Int. Cl.
*B65H 1/04* (2006.01)
*B65H 31/00* (2006.01)

(52) U.S. Cl.
CPC ..... *B65H 31/00* (2013.01); *B65H 1/04* (2013.01); *B65H 2402/31* (2013.01); *B65H 2402/54* (2013.01); *B65H 2405/354* (2013.01); *B65H 2601/523* (2013.01)

(58) Field of Classification Search
CPC ..... B65H 1/04; B65H 11/00; B65H 31/00; B65H 2402/31; B65H 2402/54; B65H 2405/354; B65H 2601/523
See application file for complete search history.

(56) References Cited

U.S. PATENT DOCUMENTS

| | | | | |
|---|---|---|---|---|
| 7,905,482 | B2 * | 3/2011 | Matsumoto | B65H 31/02 271/213 |
| 8,857,812 | B2 * | 10/2014 | Yamamoto | B65H 1/04 271/9.09 |
| 9,139,389 | B2 * | 9/2015 | Uchino | B65H 3/66 |
| 9,261,855 | B2 * | 2/2016 | Fujinaka | G03G 21/1867 |
| 10,221,024 | B2 * | 3/2019 | Uchino | G03G 15/6514 |
| 10,301,139 | B2 * | 5/2019 | Kaneko | B65H 31/20 |
| 10,958,806 | B2 | 3/2021 | Ishihara et al. | H04N 1/10 |
| 11,286,124 | B2 * | 3/2022 | Kannari | B65H 1/04 |
| 11,345,172 | B2 | 5/2022 | Saito et al. | B41J 13/10 |
| 2014/0246825 | A1 | 9/2014 | Takemura et al. | |
| 2021/0047139 | A1 * | 2/2021 | Kannari | B65H 1/04 |

FOREIGN PATENT DOCUMENTS

JP 2013-039797 2/2013

* cited by examiner

*Primary Examiner* — Leslie A Nicholson, III
(74) *Attorney, Agent, or Firm* — Venable LLP

(57) ABSTRACT

A recording apparatus includes a housing configured to house a recording portion recording an image on a sheet and to have a side including an opening through which the sheet passes, a tray configured to rotate about a rotation shaft, relative to the housing, between a closed position at a first angle for closing the opening and an open position at a second angle for loading the sheet, and an urging mechanism configured to urge the tray toward the closed position when an angle about the rotation shaft of the tray is between the first angle and a third angle and to urge the tray toward the open position when an angle about the rotation shaft of the tray is between the third angle and the second angle. The third angle is an angle between the first angle and the second angle.

16 Claims, 20 Drawing Sheets

RECORDING APPARATUS

BACKGROUND OF THE INVENTION

Field of the Invention

The present invention relates to a recording apparatus that records an image on a recording material.

Description of the Related Art

A recording apparatus, typified by a color printer for example, may have a paper feed tray (feed tray) for loading unprinted sheets on the front side of the apparatus and a paper discharge tray (discharge tray) for loading printed sheets near the paper discharge port. Another known recording apparatus also includes an opening portion that enables access to the inside of the main body from the outside so that the recording head and the ink tank for printing can be attached and detached, and an access cover for closing the opening portion, with the access cover being located above the paper feed tray and being able to be opened and closed. For example, Japanese Patent Application Publication No. 2013-39797 describes a recording apparatus having an access cover and a paper feed tray, which are rotationally supported by the housing, and a paper discharge tray, which is rotationally supported by the access cover. The rotation fulcrum of the paper discharge tray is displaced from the rotation fulcrum of the paper feed tray and the access cover, which are coaxial. This configuration allows the paper discharge tray and the paper feed tray to be housed on the same surface side to reduce the size of the apparatus. The configuration also ensures that the fed paper is separated from the discharged paper, thereby increasing the reliability of sheet feeding.

SUMMARY OF THE INVENTION

However, since the paper discharge tray of the known art is held by the access cover located above the paper feed tray, the paper discharge tray interferes with the paper feeding operation by a user in an paper feeding action. Also, if the paper discharge tray and the paper feed tray are arranged closer to each other to further reduce the size of the main body, the paper feeding operation space used by the user would be reduced.

The paper feeding operation space can be increased by designing the apparatus such that the paper discharge tray is locked in a state of closing, during a paper feeding operation, at a position closer to the housing than the position during paper discharge. However, this increases the amount of operation performed by the user to rotate the paper discharge tray. Alternatively, a tension spring or the like may be used to urge the paper discharge tray toward the main body to secure a large paper feeding operation space while minimizing the movement amount of the user operation. However, this would urge the paper discharge tray in the closing direction during a printing operation, so that the paper discharge tray may be closed due to an impact or the like. This may hinder the printing operation. That is, an attempt to increase the paper feeding operation space encounters the problem that the reduction in the amount of tray opening operation and the stability of the orientation of the tray during paper discharge are difficult to achieve simultaneously.

It is an object of the present invention to provide a technique that reduces the amount of operation by the user, stabilizes the orientation of the discharge tray, and secures the operation space for sheet feeding.

To achieve the above object, a recording apparatus of the present invention includes:

a housing configured to house a recording portion recording an image on a sheet and to have a side including an opening through which the sheet passes;

a tray configured to rotate about a rotation shaft, relative to the housing, between a closed position at a first angle for closing the opening and an open position at a second angle for loading the sheet, and an urging mechanism configured to urge the tray toward the closed position in a case where an angle about the rotation shaft of the tray is between the first angle and a third angle and to urge the tray toward the open position in a case where an angle about the rotation shaft of the tray is between the third angle and the second angle, wherein the third angle is an angle between the first angle and the second angle.

According to the present invention, it is possible to reduce the amount of operation by the user, stabilize the orientation of the discharge tray, and secure the operation space for sheet feeding.

Further features of the present invention will become apparent from the following description of exemplary embodiments with reference to the attached drawings.

DESCRIPTION OF THE EMBODIMENTS

Figure 1A:
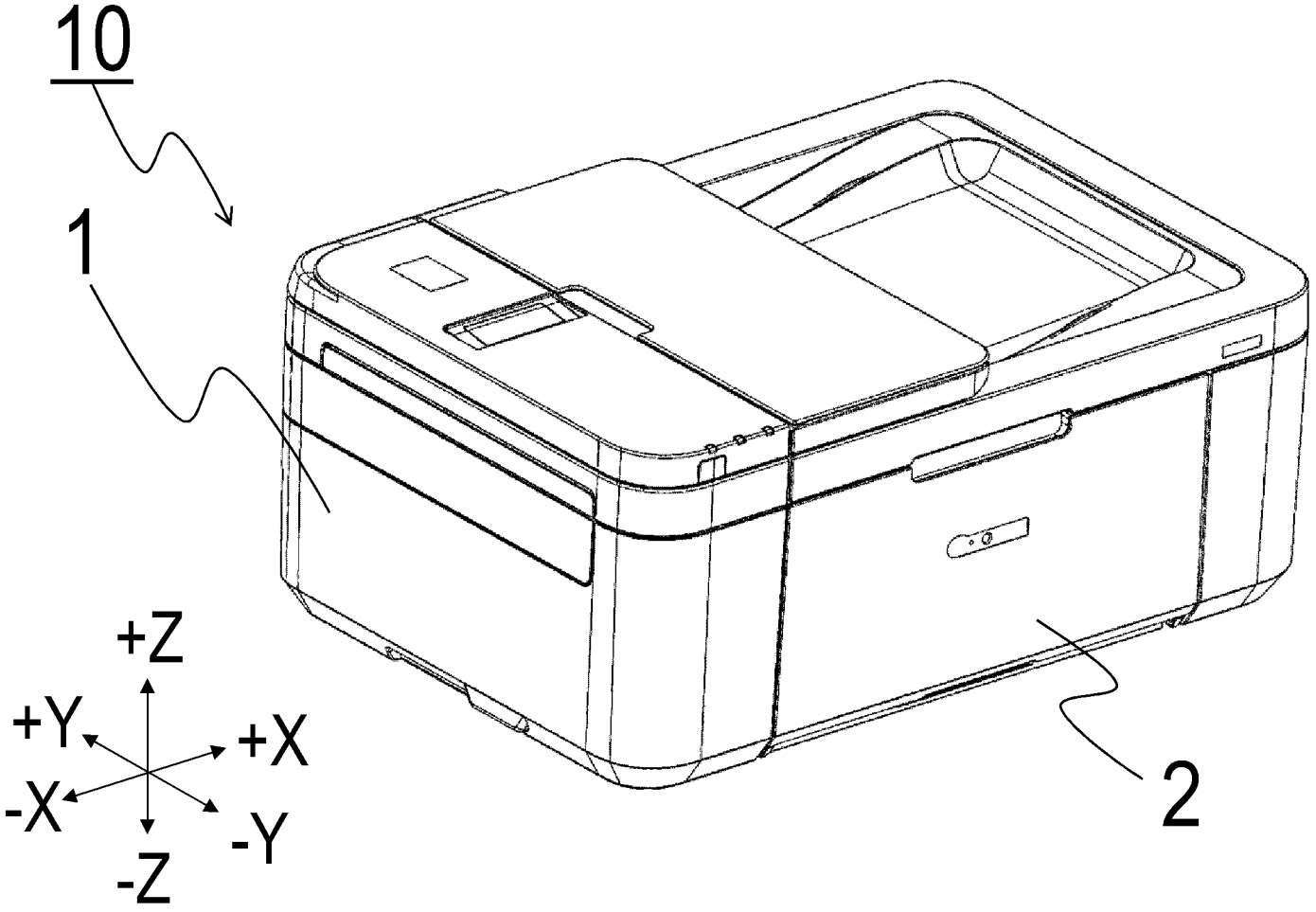
FIGS. 1A, 1B, and 1C are schematic views of a recording apparatus.

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

This embodiment illustrates a recording apparatus of a liquid discharge system (inkjet system) that discharges liquid for recording (typically, ink) toward a recording medium. The recording system of the recording apparatus is not limited to a specific system, and the present invention is also applicable to an electrophotographic recording apparatus, for example.

The term "recording" encompasses not only the formation of significant information such as characters and figures, but also the formation of images, designs, patterns, and the like on a recording medium or the processing of a medium, regardless of whether the information is manifested in a manner that is visually perceivable by humans. Also, the "recording medium" is assumed to be sheet-shaped paper in the present embodiment, but it may be cloth, plastic film, or the like.

Of the directions of the arrows shown in the drawings, an apparatus width direction is referred to as an X direction, an apparatus depth direction is referred to as a Y direction, and an apparatus height direction is referred to as a Z direction. In these directions, as indicated by the arrows in the drawings, the X directions may be referred to as left and right, the Y directions may be referred to as near/front/tip end and back/rear/back end, and the Z directions may be referred to as up and down. All directions are defined with reference to the installation surface of the recording apparatus. For example, when the recording apparatus is installed on a horizontal plane as a normally expected installation state, the Z directions, which are the height directions, coincide with vertical directions, and the X and Y directions coincide with horizontal directions. Furthermore, the X, Y, and Z directions each include two types of directions, a plus direction and a minus direction, and may be distinguished in descriptions.

Figure 1B:
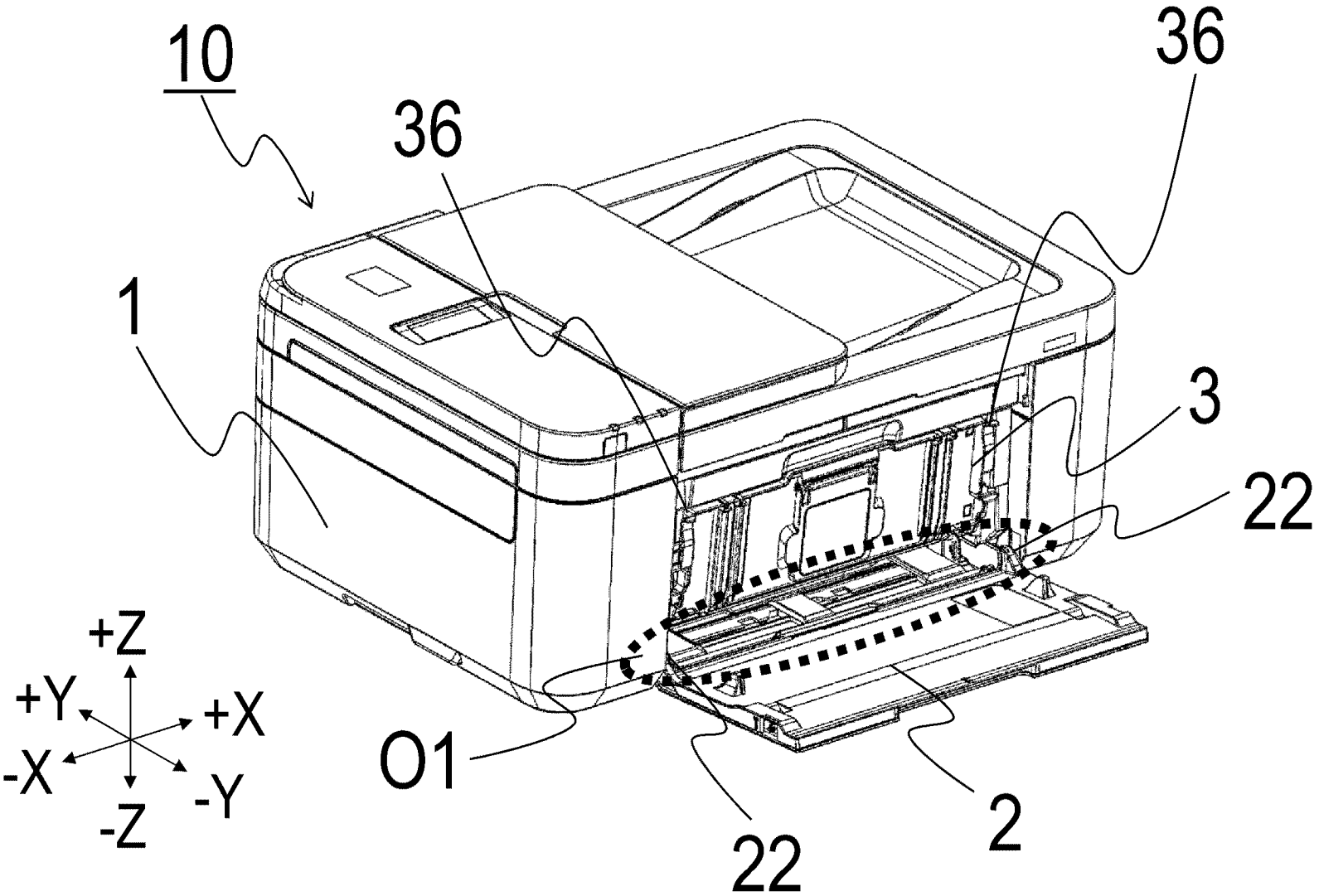
Figure 1C:
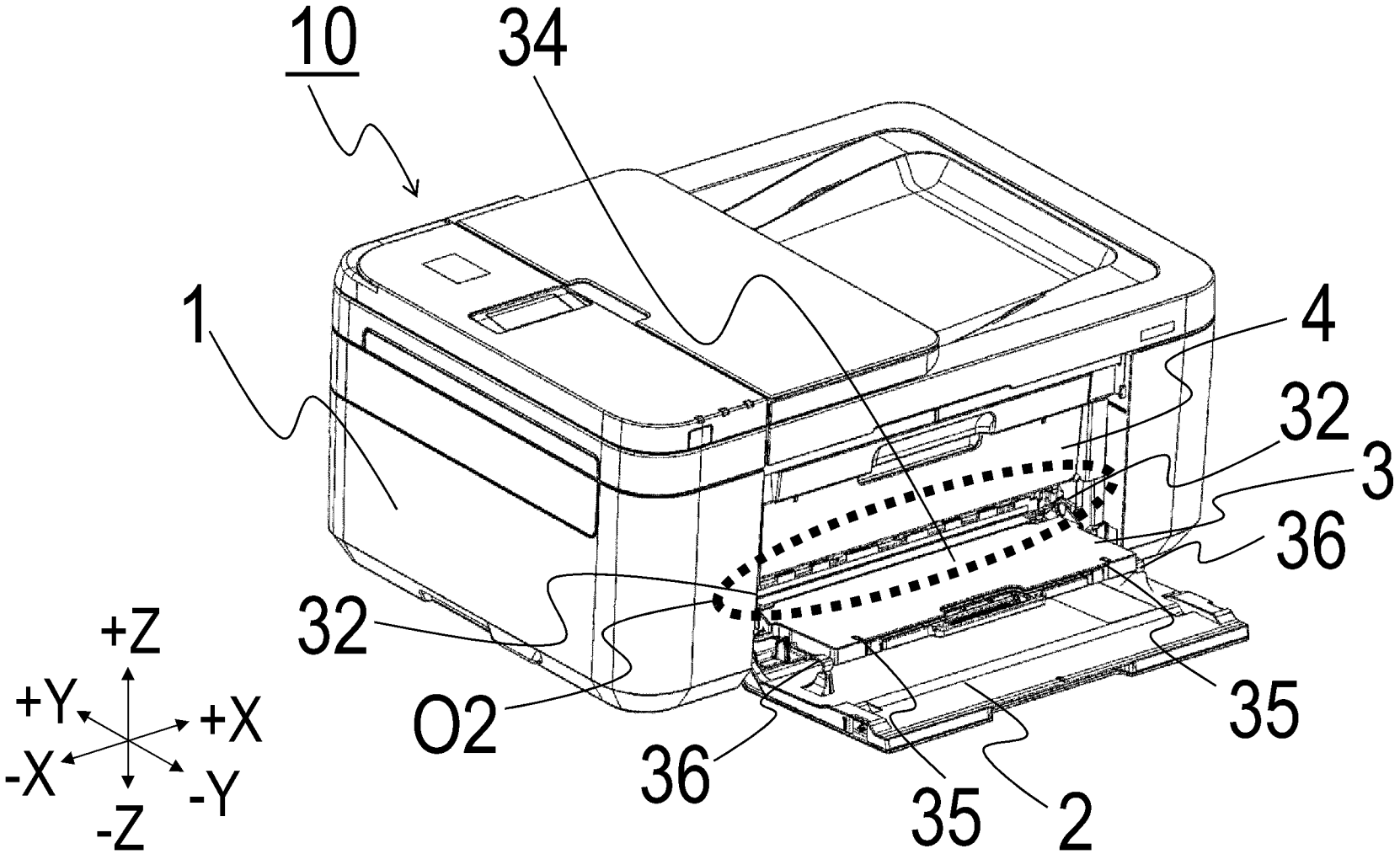

FIGS. 1A, 1B, and 1C are schematic views showing a recording apparatus 10 of a first embodiment of the present invention. FIG. 1A is a perspective view showing the recording apparatus 10 in a state in which a paper feed tray 2 and a paper discharge tray 3 are both housed in a housing 1 (closed state). FIG. 1B is a perspective view showing the recording apparatus 10 in a state in which only the paper feed tray 2 is open (the paper discharge tray 3 is in the closed state). In the opening of the housing 1, only a paper feed region O1 is open. FIG. 1C is a perspective view showing the recording apparatus 10 in a state in which both the paper feed tray 2 and the paper discharge tray 3 are open. That is, in the opening of the housing 1, the paper feed region O1 and a paper discharge region O2 are both open to the outside.

The recording apparatus 10 according to the present embodiment has the housing 1 shown in FIG. 1A. The housing 1 has a side that rotationally supports the paper feed tray 2, on which paper 9 before image formation is loaded, and the paper discharge tray 3, on which the paper 9 after image formation is loaded. That is, the housing 1 houses a recording portion 6 for recording an image on a sheet described below and has a side including an opening for allowing the paper 9 to be fed to the recording portion 6 from the outside of the housing 1 and for allowing the paper 9 to be discharged from the recording portion 6 to the outside. In this embodiment, this opening is configured to be opened and closed by triple opening and closing members. That is, the three opening and closing members, including a rearmost access cover 4, the paper discharge tray (discharge tray) 3 outward of the access cover 4, and the outermost paper feed tray (feed tray) 2, are coupled to the housing 1.

The paper discharge tray 3 is configured to load the paper 9 (generally the paper 9 on which recording has been performed) discharged from the recording portion 6. The paper discharge tray 3 is supported by the housing 1 through a rotation shaft (first rotation shaft) 32 so as to be rotatable about a rotation axis extending along the lower side of the opening of the housing 1 near the lower end of the opening. The paper discharge tray 3 is a substantially rectangular plate-shaped member, and its inner surface in the opening and closing direction serves as the loading surface for the paper 9 discharged from the recording portion 6.

When the paper discharge tray 3 is at a rotation phase where the edge of the paper discharge tray 3 that is opposite to the long side including the rotation shaft 32 is substantially located over the rotation shaft 32, that is, when the planar paper discharge tray 3 is substantially upright, the paper discharge tray 3 takes a closed position (first closed position). In this closed position, the paper discharge tray 3 closes the paper discharge region (sheet discharge region) O2, which is the region in the opening of the housing 1 that is not closed by the access cover 4 and through which the paper 9 discharged from the recording portion 6 passes. When the paper discharge tray 3 is in an orientation in which the edge including the rotation shaft 32 and the opposite edge are aligned with each other substantially in the horizontal direction, that is, in an orientation in which the planar paper discharge tray 3 substantially extends in the horizontal direction, the paper discharge tray 3 takes an open position (first open position) that fully opens the paper discharge region O2 to the outside.

The paper feed tray 2 is configured to load sheets to be fed to the recording portion 6. The paper feed tray 2 is supported by the housing 1 through a rotation shaft (second rotation shaft) 22 so as to be rotatable about a rotation axis extending along the lower side of the opening of the housing 1 near the lower end of the opening and below the rotation shaft 32 of the paper discharge tray 3. The paper feed tray 2 is a substantially rectangular plate-shaped member, and its inner surface in the opening and closing direction serves as the sheet loading surface, while the outer surface forms a part of the exterior surface of the housing 1.

When the paper feed tray 2 is at a rotation phase where the edge of the paper feed tray 2 that is opposite to the long side including the rotation shaft 22 is substantially located over the rotation shaft 22, that is, when the planar paper feed tray 2 is substantially upright, the paper feed tray 2 takes a closed position (second closed position). In this closed position, the paper feed tray 2 closes the paper feed region (sheet feed region) O1, which is the region in the opening of the housing 1 that is not closed by the paper discharge tray 3 and through which the paper 9 is fed to the recording portion 6. When the paper feed tray 2 is in an orientation in which the edge including the rotation shaft 22 and the opposite edge are aligned with each other substantially in the horizontal direction, that is, in an orientation in which the planar paper feed tray 2 substantially extends in the horizontal direction, the paper feed tray 2 takes an open position (second open position) that opens the paper feed region O1 to the outside.

The orientation in which the paper discharge tray 3 is housed in the housing 1 as shown in FIGS. 1A and 1B is referred to as a first orientation, while the opened orientation as shown in FIG. 1C is referred to as a second orientation. The paper discharge tray 3 takes the first orientation when the paper 9 is fed to the paper feed tray 2 and takes the second orientation when the paper after image formation is loaded on the paper discharge tray 3. When the paper runs out during an image forming operation, the user needs to move the paper discharge tray 3 from the second orientation to the first orientation. The amount of this operation is desirably as small as possible.

Figure 2:
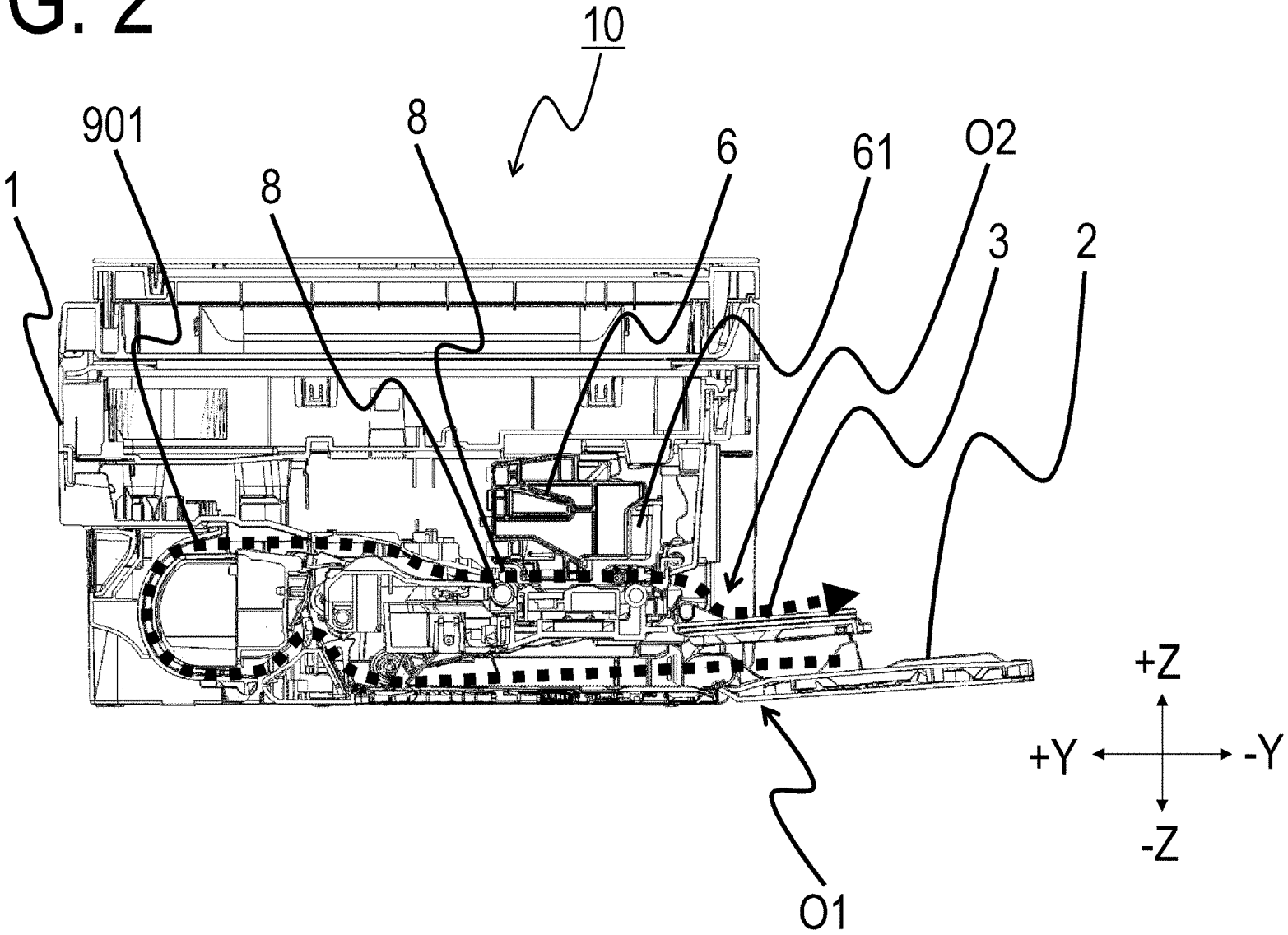
FIG. 2 is a cross-sectional view of the recording apparatus.

FIG. 2 is a cross-sectional view schematically showing the recording apparatus of the first embodiment of the present invention. The paper 9 fed to the paper feed tray 2 is conveyed along a sheet conveying path 901 indicated by the broken line in FIG. 2 by a conveying roller pair 8. The recording portion 6, which includes components such as a recording head and an ink tank 61, records an image on the paper 9. The paper 9 is then discharged to the paper discharge tray 3.

Figure 3A:
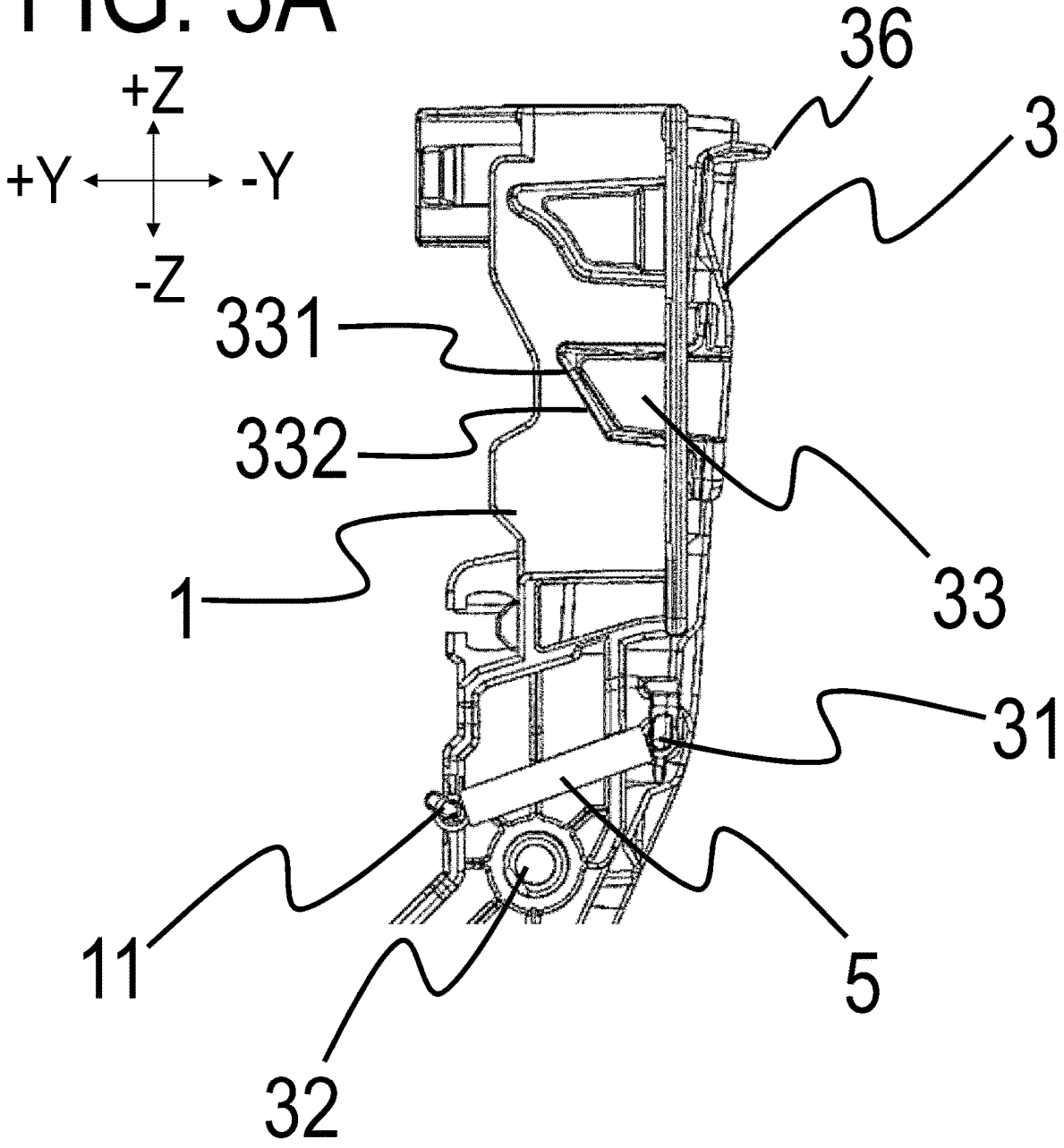
FIGS. 3A, 3B, and 3C are schematic views of a paper discharge tray of a first embodiment.
Figure 3B:
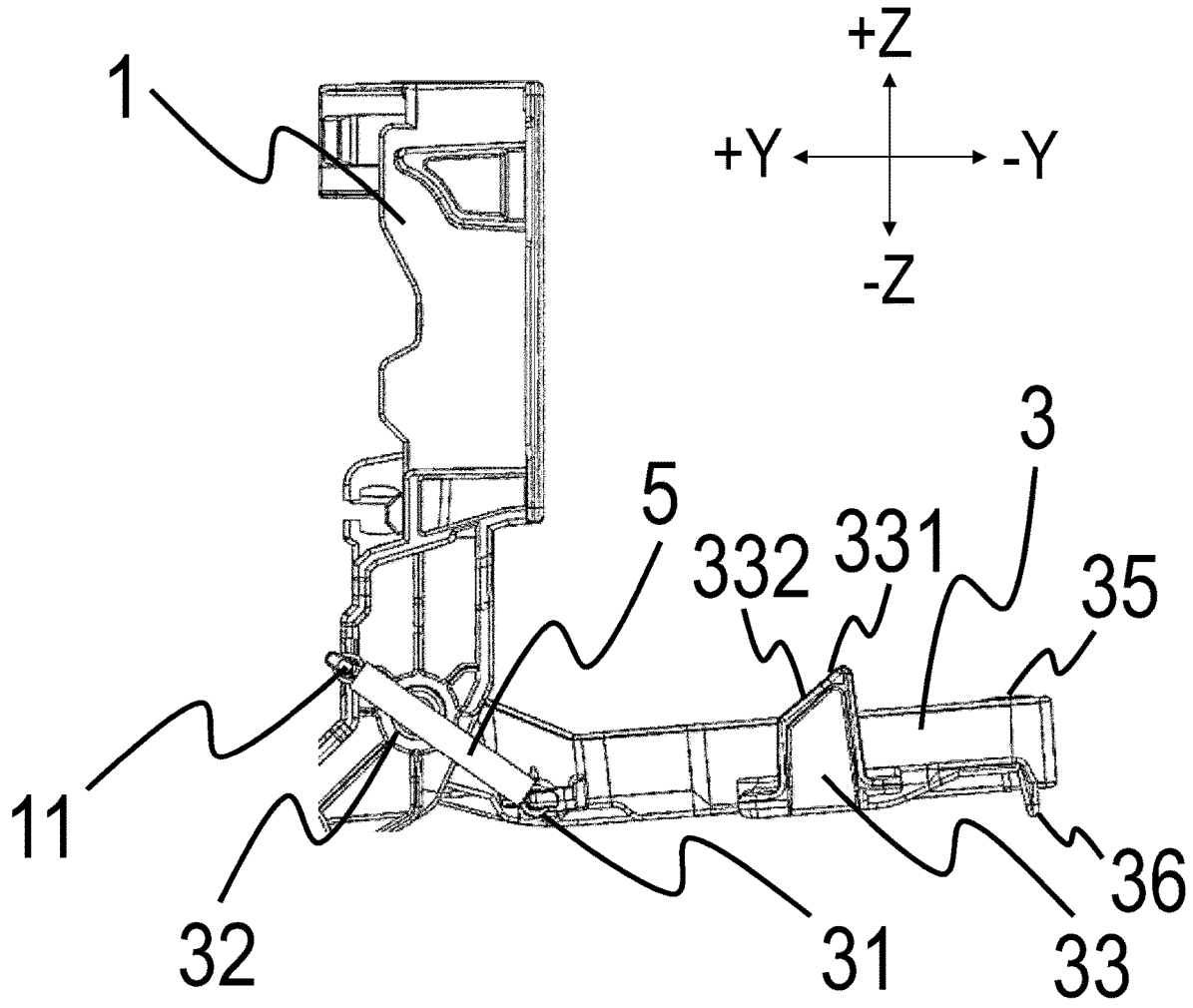
Figure 3C:
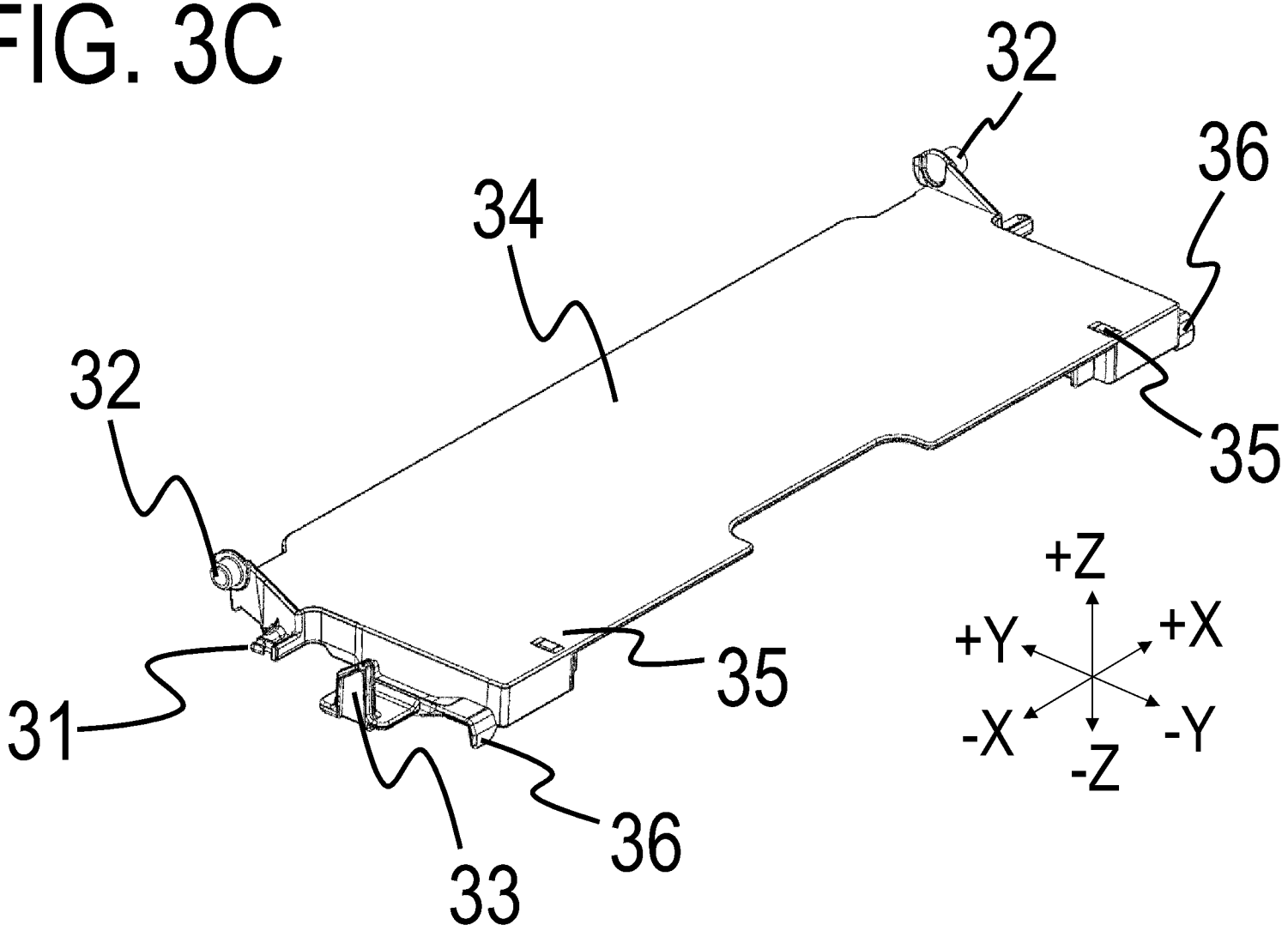

FIGS. 3A and 3B are side views schematically showing orientations of the paper discharge tray 3. FIG. 3C is a perspective view illustrating the configuration of the paper discharge tray 3. The paper discharge tray 3 is rotationally supported by the rotation shaft 32 with respect to the housing 1. An urging mechanism for applying an urging force to the paper discharge tray 3 is provided between the paper discharge tray 3 and the housing 1. The urging mechanism includes a hook 11 provided on the housing 1, a hook 31 provided on the paper discharge tray 3, and a tension spring 5, which is an example of an elastic member coupling the hook 11 to the hook 31. FIG. 3A shows a state in which the paper discharge tray 3 is in the first orientation. FIG. 3B shows a state in which the paper discharge tray 3 is in the second orientation.

The paper discharge tray 3 has closing-side rotation stop portions 35, which abut the housing 1 in the closed position, on the sheet loading surface. The urging force of the tension spring 5 maintains the rotation stop portions 35 in abutment with the housing 1, thus holding the paper discharge tray 3 in the closed position.

The paper discharge tray 3 has opening-side rotation stop portions 36, which abut the paper feed tray 2 in the open position. The rotation stop portions 36 project from the surface opposite to the sheet loading surface. The urging force of the tension spring 5 maintains the rotation stop portions 36 in abutment with the paper feed tray 2, thus holding the paper discharge tray 3 in the open position. When the paper discharge tray 3 is in the open position, the rotation stop portions 36 abut the paper feed tray 2 such that a clearance is formed between the paper discharge tray 3 and the paper feed tray 2 to secure paper loading space on the paper feed tray 2, in other words, such that the paper feed region O1 in the opening of the housing 1 is maintained open.

Figure 4:
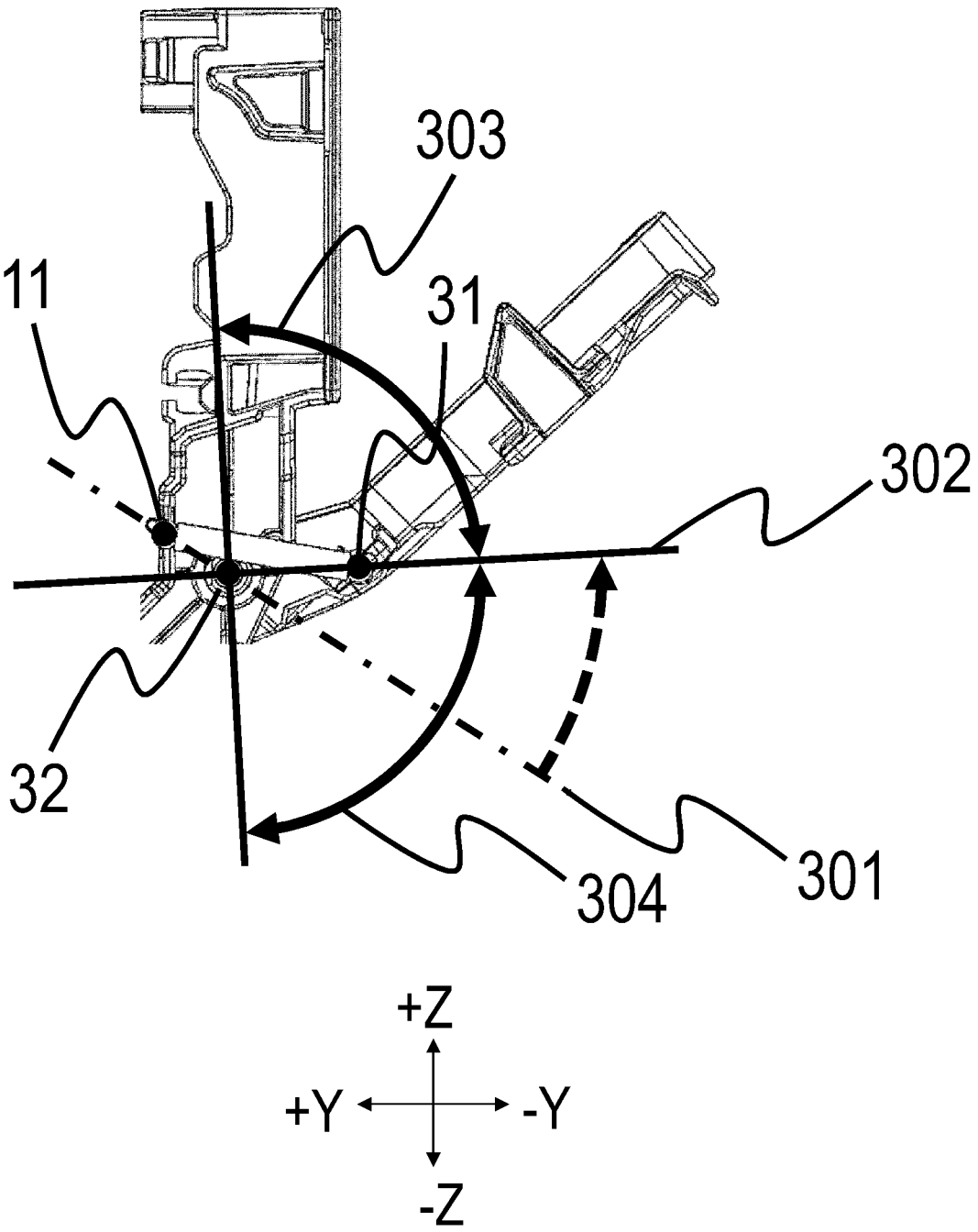
FIG. 4 is a schematic side view of the paper discharge tray of the first embodiment.

FIG. 4 is an explanatory diagram in which additional lines are drawn on a side view schematically showing an orientation of the paper discharge tray 3 for the purpose of explaining the holding position of the elastic member.

A dashed dotted line 301 indicates a straight line connecting the housing hook 11 to the rotation center of the paper discharge tray 3 (the central axis of the rotation shaft 32). A solid line 302 indicates a straight line connecting the paper discharge tray hook 31 to the rotation center of the paper discharge tray 3 (the central axis of the rotation shaft 32). When the paper discharge tray hook 31 is positioned on the dashed dotted line 301, the paper discharge tray 3 is at a dead center where the tensile force of the tension spring 5 does not act in a rotation direction of the paper discharge tray 3. When the orientation of this dead center is present between the first orientation and the second orientation, a toggle mechanism is formed in which the moment caused by the spring tensile force and acting on the paper discharge tray 3 is reversed during the opening and closing of the paper discharge tray 3.

Taking into account the moment caused by the weight of the paper discharge tray 3, there is an orientation of the paper discharge tray 3 in which the moment of the weight of the paper discharge tray 3 and the tensile force of the spring 5 are balanced and an apparent dead center is reached. This orientation is hereinafter referred to as a third orientation. When the third orientation exists between the first orientation and the second orientation, a configuration is formed in which the paper discharge tray 3 located at the closing side of the third orientation is pulled toward the first orientation, whereas the paper discharge tray 3 located at the opening side of the third orientation is pulled toward the second orientation.

Unlike a common configuration in which the pulling direction is a single direction, the tension spring 5 held in the above configuration allows the pulling direction to be reversed during an opening and closing action of the paper discharge tray 3. FIG. 4 shows the straight line 302 connecting the paper discharge tray hook 31 in the third orientation to the rotation center (the rotation shaft 32) of the paper discharge tray 3, and a region 303 and a region 304 that are on opposite sides of the straight line 302. The paper discharge tray 3 is pulled toward the first orientation in the region 303 and is pulled toward the second orientation in the region 304.

In other words, the urging direction of the tension spring 5 changes at a third angle (the third orientation) of the paper discharge tray 3 about the rotation axis of the rotation shaft 32. The third angle is between a first angle at which the paper discharge tray 3 is in the closed position (the first orientation) and a second angle at which the paper discharge tray 3 is in the open position (the second orientation). When the paper discharge tray 3 is at an angle between the third angle and the first angle, the urging force that rotates the paper discharge tray 3 in the closing direction from the third angle to the first angle (first urging force) is applied to the paper discharge tray 3 by the tension spring 5. Also, when the paper discharge tray 3 is at an angle between the third angle and the second angle, the urging force that rotates the paper discharge tray 3 in the opening direction from the third angle to the second angle (second urging force) is applied to the paper discharge tray 3 by the tension spring 5.

Figure 5A:
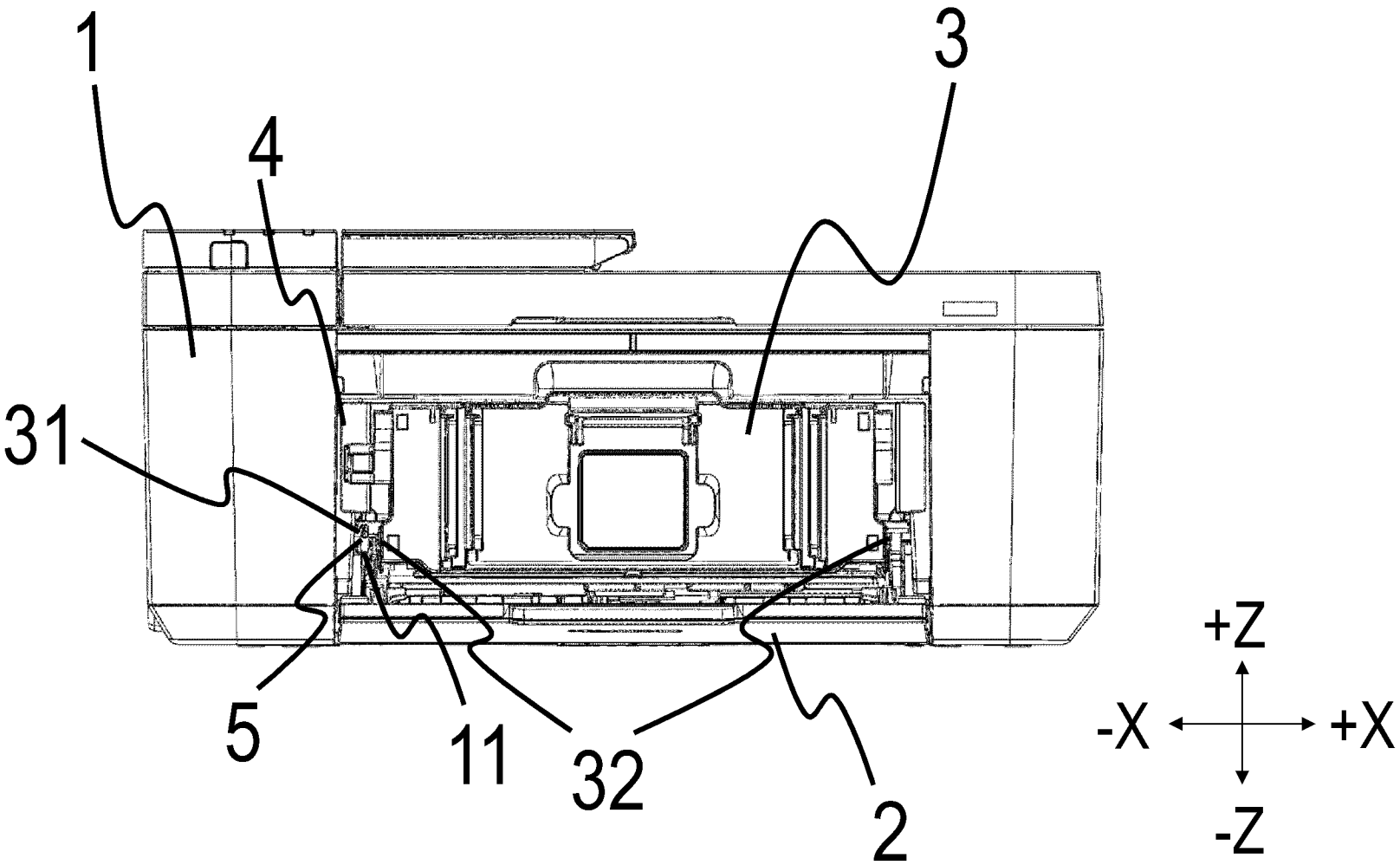
FIGS. 5A and 5B are front views of the recording apparatus.
Figure 5B:
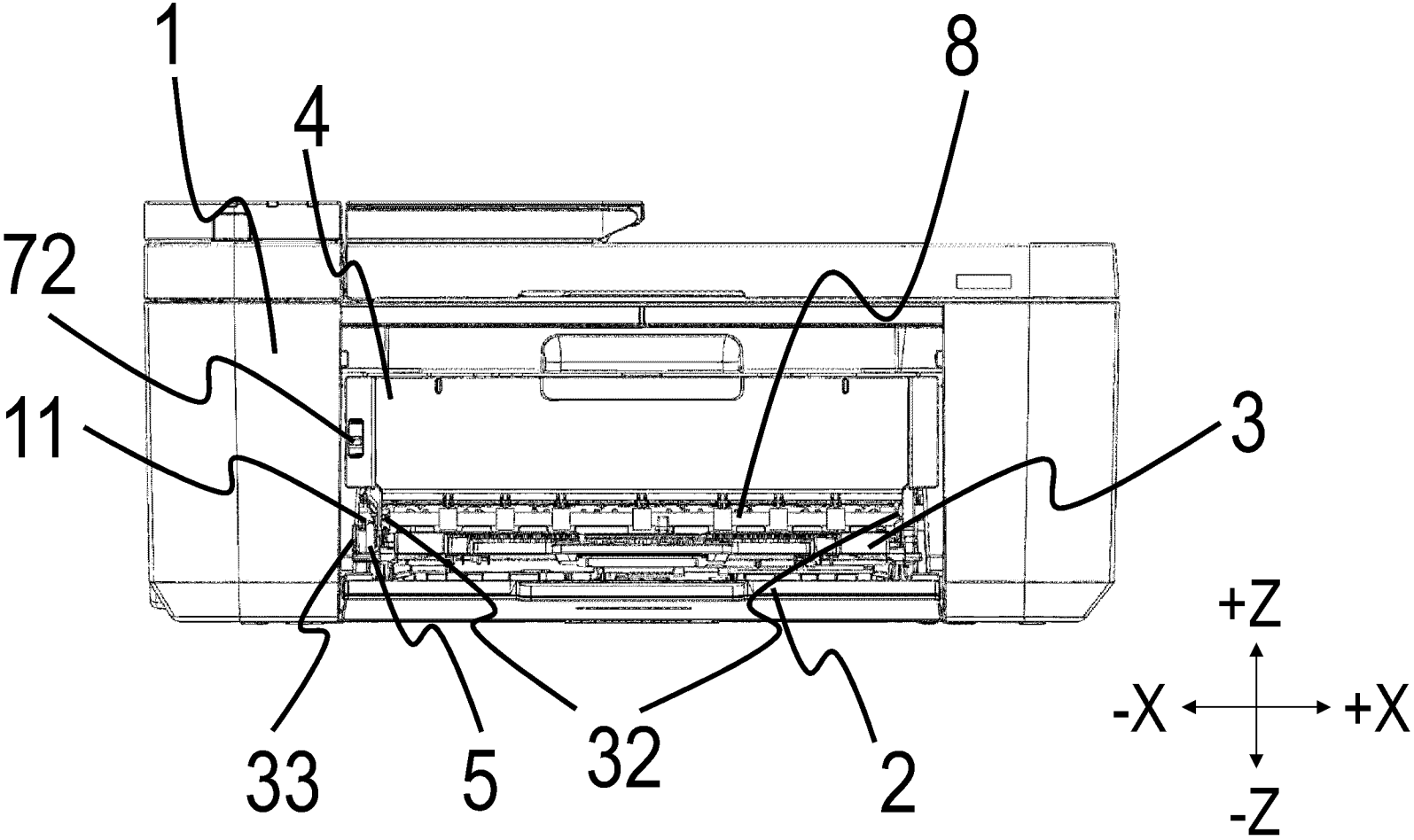

As shown in FIGS. 5A and 5B, the tension spring 5 is arranged outward of the rotation shaft 32 in the axial direction of the rotation shaft 32. FIG. 5A is a front view of the recording apparatus 10 with the paper discharge tray 3 in the closed state, and FIG. 5B is a front view of the recording apparatus 10 with the paper discharge tray 3 in the open state. One end of the tension spring 5 is held by the housing 1 and the other end is held by the paper discharge tray 3 such that the tension spring 5 is displaced across the axis of the rotation shaft 32 when the paper discharge tray 3 rotates between the first angle and the second angle.

According to the above configuration, for a paper feeding operation, once the paper discharge tray 3 is rotated to the third position, the paper discharge tray 3 is pulled toward the closing side. The operation amount is therefore reduced. Furthermore, the paper discharge tray 3 is continuously urged to the second orientation during an image forming operation, thereby stabilizing the orientation during the operation.

Second Embodiment

Figure 6:
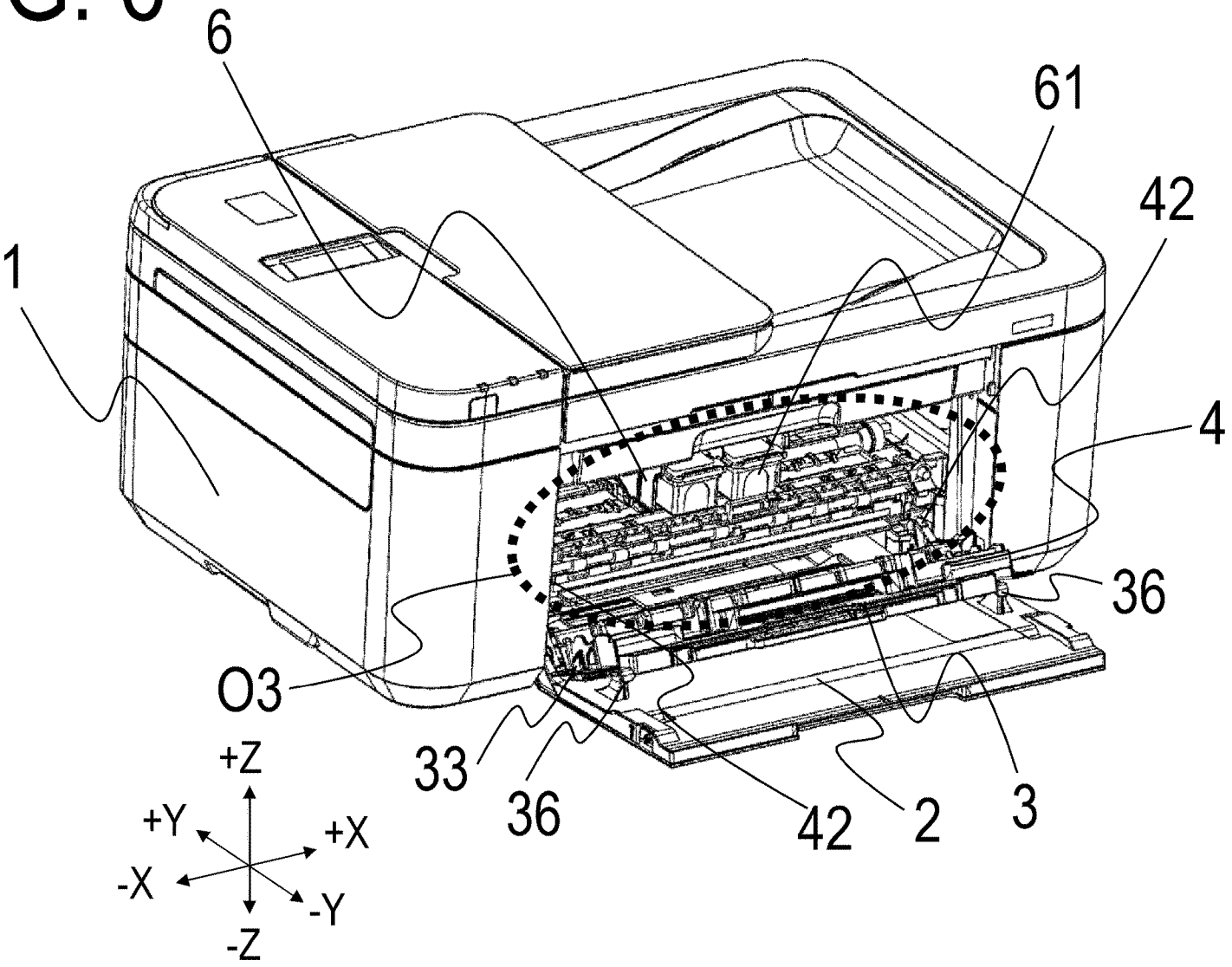
FIG. 6 is a schematic view of a recording apparatus of a second embodiment.
Figure 7A:
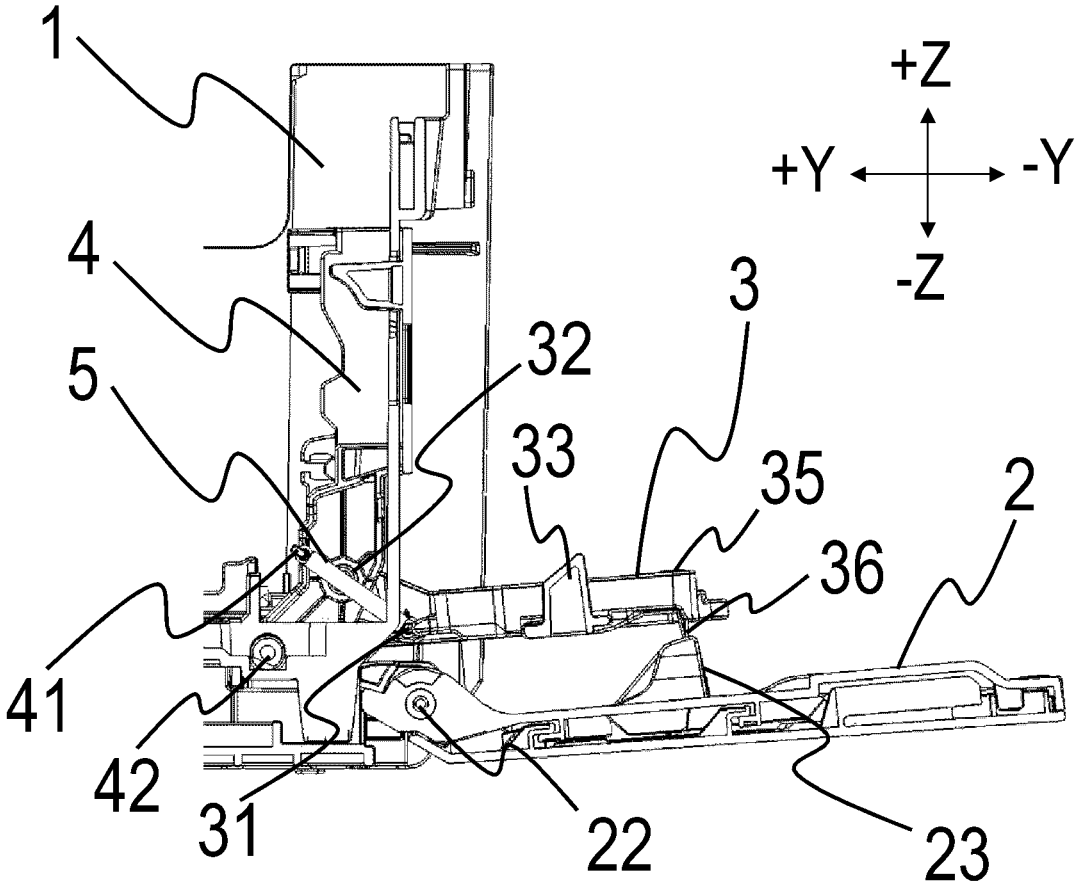
FIGS. 7A and 7B are enlarged cross-sectional views of the surrounding of a paper discharge tray of the recording apparatus of the second embodiment.
Figure 7B:
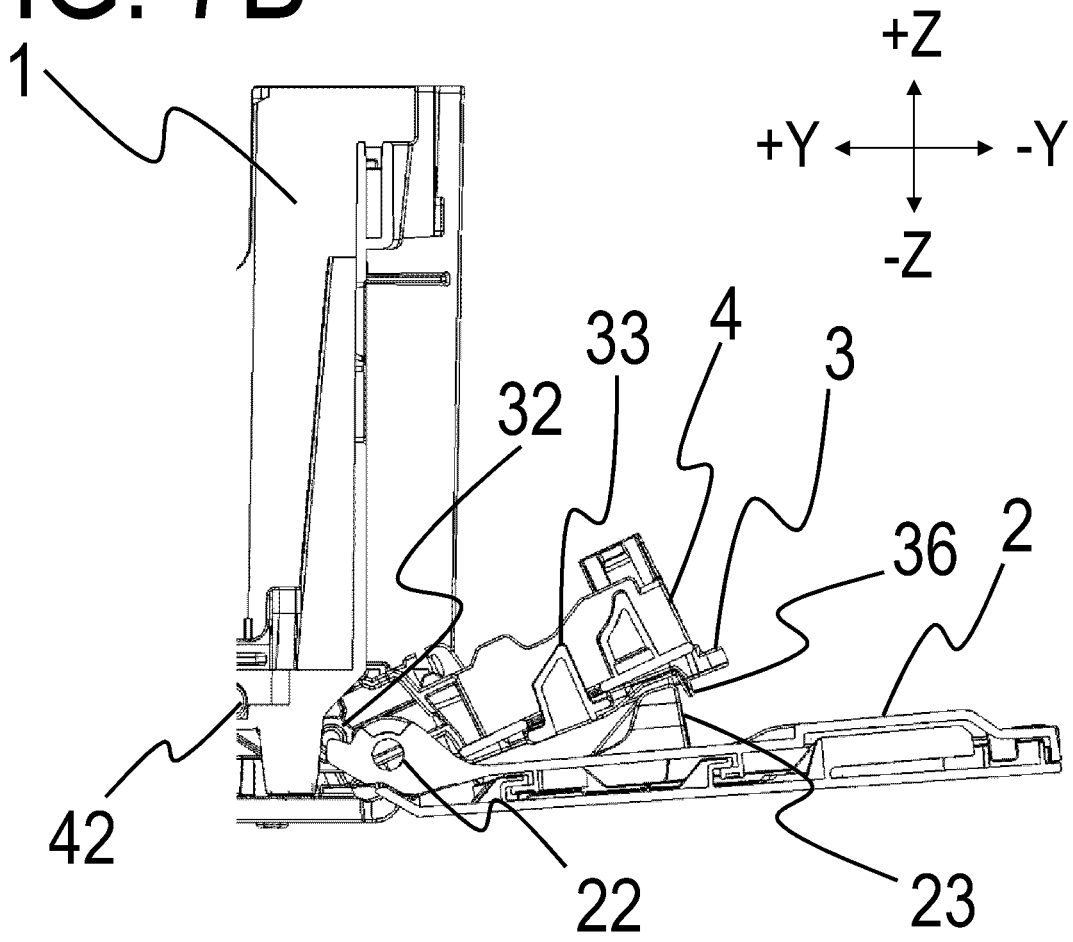

Referring to FIGS. 6, 7A, and 7B, a recording apparatus according to a second embodiment of the present invention is now described. In the following description, the description of the matters of the second embodiment common to the first embodiment is omitted. The configuration of the second embodiment that is not described below is the same as the configuration of the first embodiment.

FIG. 6 is a schematic perspective view showing a state in which the access cover 4 is rotated to the open side. That is, FIG. 6 shows a state in which an access region O3 for exposing the recording portion 6 to the outside is opened in the opening of the housing 1. FIGS. 7A and 7B are cross-sectional views that show the configuration of the recording apparatus around the access cover 4 and also show the configurations of the paper feed tray 2, the paper discharge tray 3, and the access cover 4, in particular, the arrangement configurations of the rotation shafts of the respective members. FIG. 7A shows the access cover 4 in the closed state (the paper feed tray 2 and the paper discharge tray 3 are in the open state), and FIG. 7B shows the access cover 4 in the open state. The access cover 4 is located inward of the paper discharge tray 3 in the housing 1 and supported by the housing 1 through a rotation shaft (third rotation shaft) 42 so as to be rotatable about a rotation axis extending along the lower side of the opening of the housing 1 near the lower end of the opening and above the rotation shaft 22 of the paper feed tray 2. When the access cover 4, which is a substantially rectangular plate-shaped member, is at a rotation phase where the edge of the access cover 4 that is opposite to the long side including the rotation shaft 42 is substantially located over the rotation shaft 42, that is, when the planar access cover 4 is substantially upright, the access cover 4 takes a closed position (third closed position). In this closed position, the access region O3 is closed. When the access cover 4 is in an orientation in which the edge including the rotation shaft 42 and the opposite edge are aligned with each other substantially in the horizontal direction, that is, in an orientation in which the planar access cover 4 substantially extends in the horizontal direction, the access cover 4 takes an open position (third open position) that opens the access region O3 to the outside.

As shown in FIGS. 1C, 6, 7A, and 7B, the access cover 4 may be rotationally held by one side of the housing 1 to enable actions of attaching and detaching the recording head and the ink tank 61, which stores recording liquid such as ink to be supplied to the recording head, of the recording portion 6 for forming an image on the paper 9. According to the above configuration, the ink tank 61 can be attached and detached from the same side as the paper feed and discharge operations. In the second embodiment, the rotation shaft 32 of the paper discharge tray 3, which is held by the housing 1 in the first embodiment, is held by the access cover 4. Additionally, the urging mechanism such as the tension spring 5, which is held between the paper discharge tray 3 and the housing 1 in the first embodiment, is held between the paper discharge tray 3 and the access cover 4.

As shown in FIGS. 7A and 7B, in this embodiment, the paper discharge tray 3 is rotationally supported by the access cover 4 through the rotation shaft 32. That is, the paper discharge tray 3 of the present embodiment is supported by the housing 1 through the access cover 4. When the access cover 4 rotates relative to the housing 1, the paper discharge tray 3 changes its orientation in synchronization with the movement of the access cover 4. Specifically, when the access cover 4 is about to be opened, the paper discharge tray 3 is in the open position and placed on the paper feed tray 2. As the access cover 4 is rotated toward the open position, the paper discharge tray 3 slides on the paper feed tray 2. The paper feed tray 2 has protruding support portions 23, which abut the rotation stop portions 36 of the paper discharge tray 3. As shown in FIG. 7A, when the access cover 4 is in the closed state, the distal end portion, which is bent to form a hook, of each rotation stop portion 36 abuts and is supported by the distal end portion of the support portion 23. As shown in FIG. 7B, when the access cover 4 rotates from the closed state to the open state, the hook-shaped distal end portion of the rotation stop portion 36 slides on the distal end of the support portion 23 and then falls along the back side of the support portion 23. This allows the rotation stop portion 36 to engage with the support portion 23. Each support portion 23 is shaped as a protrusion with an inclination. While the access cover 4 is returned to the closed state, the hook-shaped distal end portion of the rotation stop portion 36 slides on the surface of the support portion 23 and then returns to the state in which the distal end portion abuts the distal end of the support portion 23 as shown in FIG. 7A. The above configuration supports the orientation of the access cover 4 in an opening and closing action and stably guides the rotation of the access cover 4. Moreover, the three opening and closing members of the access cover 4, the paper feed tray 2, and the paper discharge tray 3 can stably take their opened orientations. This improves the workability for maintenance of the recording portion 6, for example.

Furthermore, as shown in FIG. 7A, in this embodiment, as the urging mechanism for applying an urging force to the paper discharge tray 3, the tension spring 5 is provided between the paper discharge tray 3 and the access cover 4. Specifically, one end of the tension spring 5 engages with a hook 41 on the access cover 4, and the other end engages with the hook 31 on the paper discharge tray 3 to couple the paper discharge tray 3 to the access cover 4. The change in the urging force of the tension spring 5 with the rotation of the paper discharge tray 3 is the same as that of the tension spring 5 in the first embodiment.

In the present embodiment configured as described above, the paper discharge tray 3 is urged toward the access cover 4 instead of toward the housing 1 during attachment or detachment of the ink tank 61. This stabilizes the orientation of the paper discharge tray 3 and the access cover 4 while the ink tank 61 is being replaced.

Third Embodiment

Figure 8A:
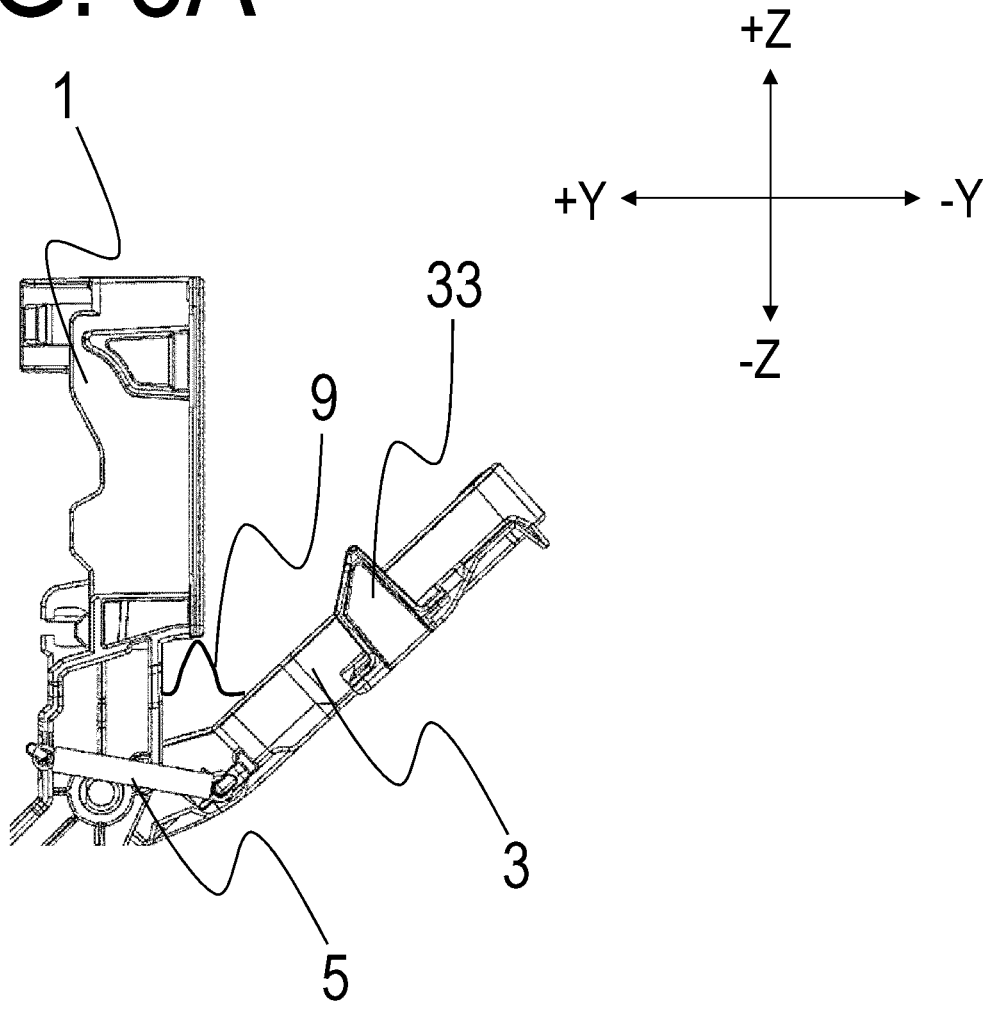
FIGS. 8A, 8B, and 8C are schematic side views showing a paper discharge tray during an image forming operation of a third embodiment.
Figure 8B:
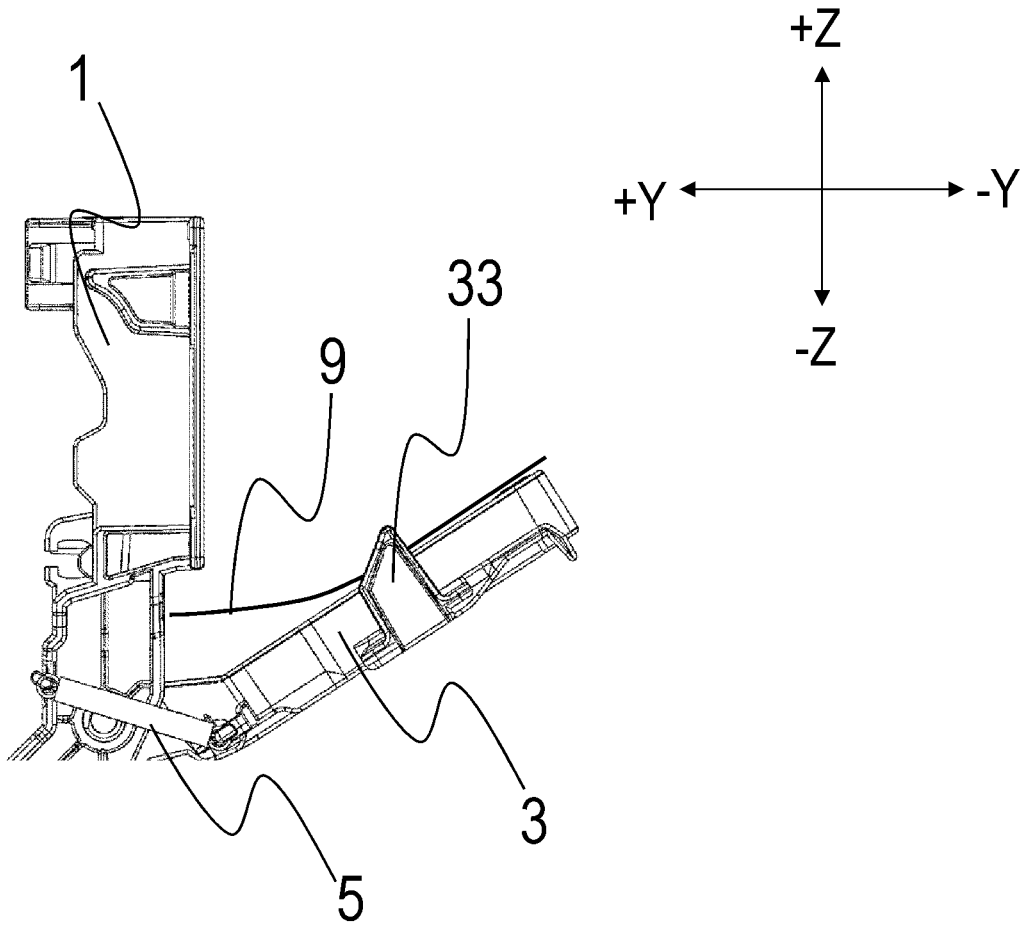
Figure 8C:
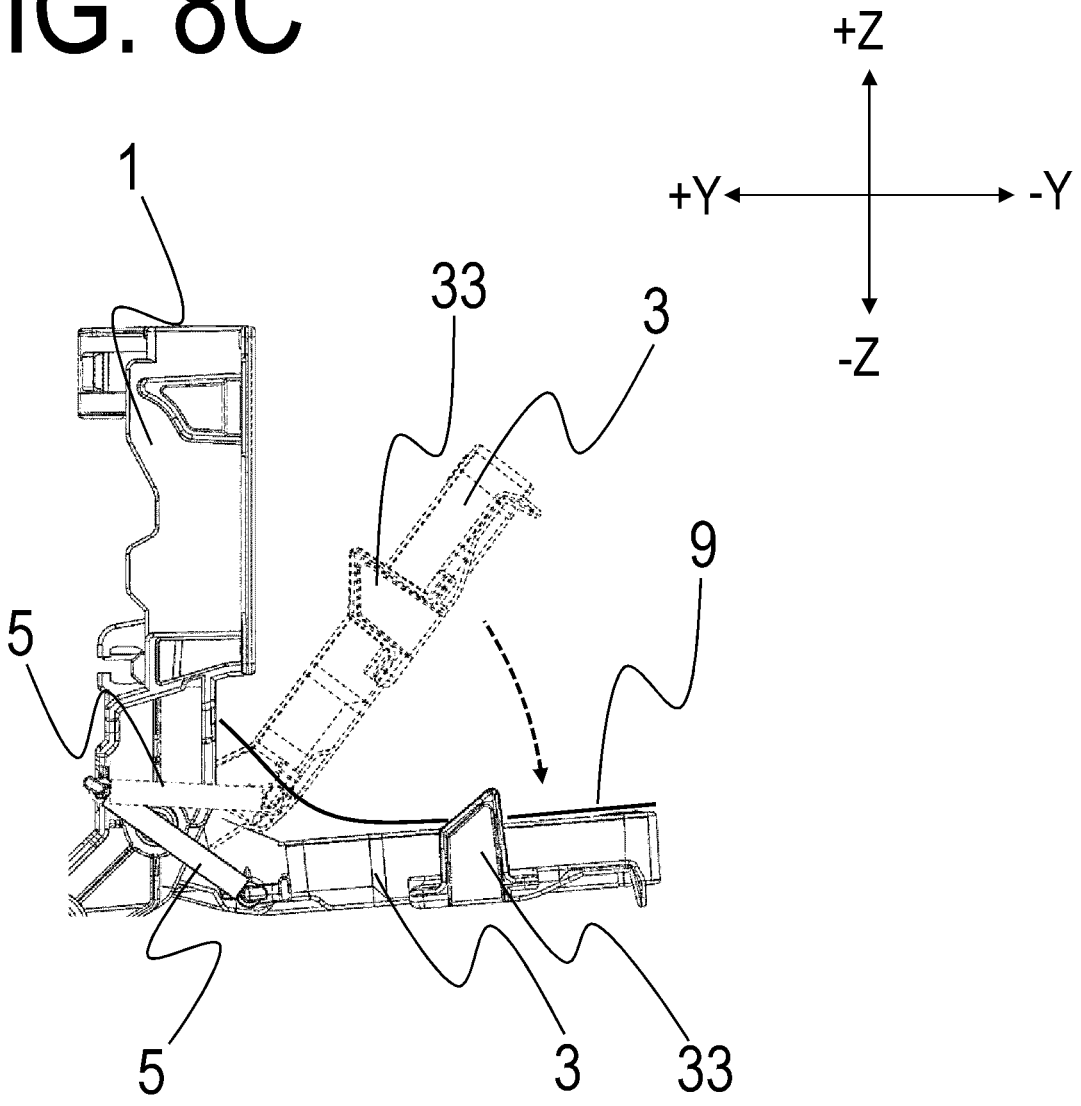

Referring to FIGS. 8A, 8B, and 8C, a recording apparatus according to a third embodiment of the present invention is now described. In the following description, the description of the matters of the third embodiment common to the first and second embodiments is omitted. The configuration of the third embodiment that is not described below is the same as the configuration of the first and second embodiments.

FIGS. 8A, 8B, and 8C are side views schematically showing states during an image forming operation in the third orientation. In the first embodiment, the tension spring 5 is configured such that, when the paper discharge tray 3 is at the third angle, the weight of the paper discharge tray 3 and the tensile force of the tension spring 5 are balanced and the tensile force does not act in a direction for rotating the paper discharge tray 3. As shown in FIG. 8A, when the paper discharge tray 3 is stationary in the third orientation, the paper 9 conveyed during an image forming operation may be stuck on the paper discharge tray 3, causing a paper discharge failure such as a paper jam. As a countermeasure, the tensile force magnitude and the holding position of the tension spring 5 may be adjusted to set the third orientation closer to the second orientation so that the paper discharge tray 3 is positioned at an angle that allows the paper 9 discharged from the recording portion 6 to be loaded. Such an adjustment allows the paper 9 to be easily laid on the paper discharge tray 3 during an image forming operation even when the paper discharge tray 3 is in the third orientation as shown in FIG. 8B. This reduces the likelihood of a paper discharge failure.

Additionally, the tensile force magnitude and holding position of the tension spring 5 and the conveying force for the paper 9 may be adjusted such that the paper discharge tray 3 is easily rotated by the pressure applied by the paper 9 abutting the paper discharge tray 3. Such an adjustment allows the paper discharge tray 3 to be more easily pulled from the third orientation toward the second orientation by the conveying force for the paper 9 as shown in FIG. 8C. This reduces the likelihood of a paper discharge failure.

Fourth Embodiment

Referring to FIGS. 9, 10A, 10B, and 11, a recording apparatus according to a fourth embodiment of the present invention is now described. In the following description, the description of the matters of the fourth embodiment common to the first to third embodiments is omitted. The configuration of the fourth embodiment that is not described below is the same as the configuration of the first to third embodiments.

Figure 9:
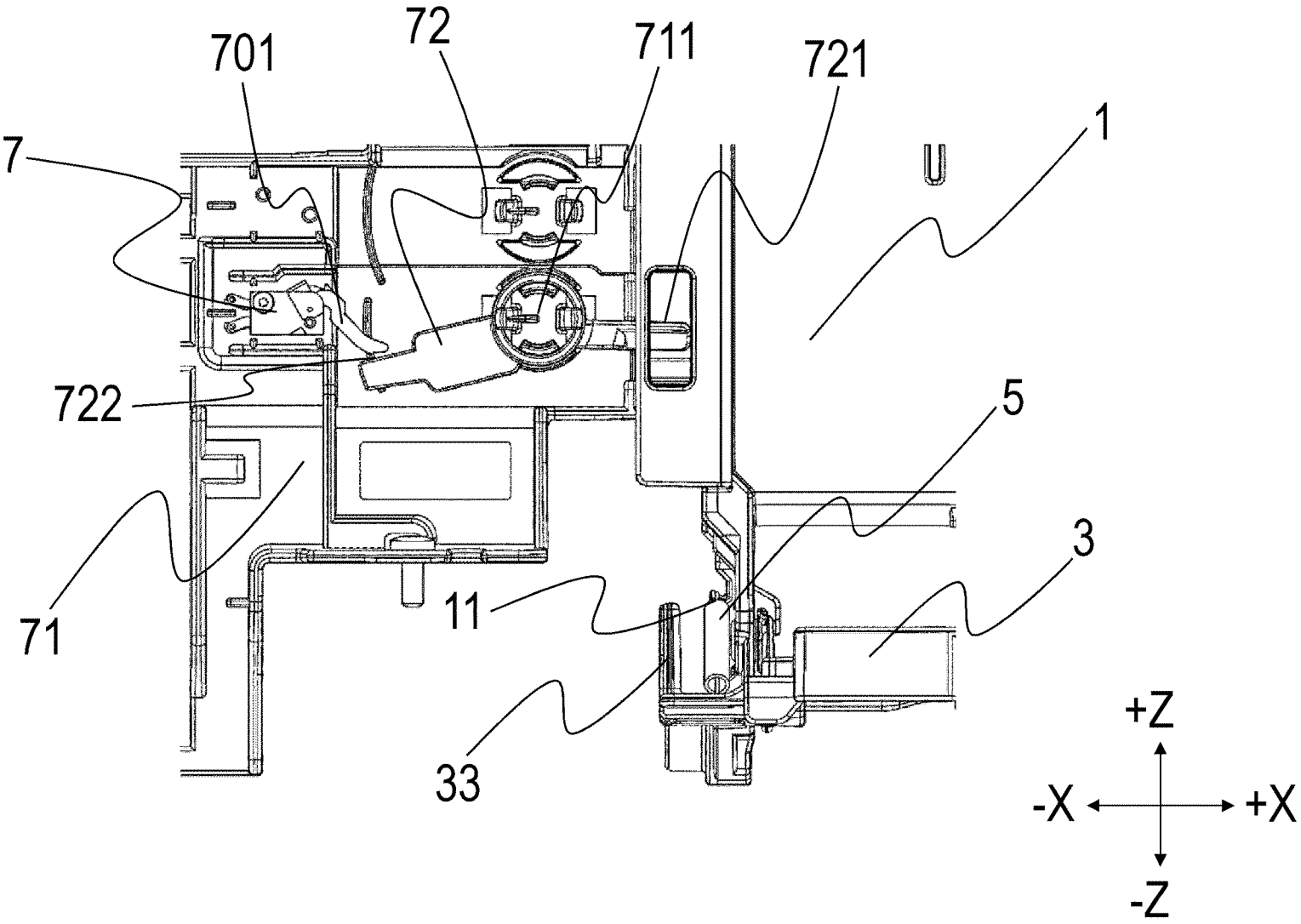
FIG. 9 is a schematic front view showing an opening and closing detection mechanism of a paper discharge tray of a fourth embodiment.
Figure 10A:
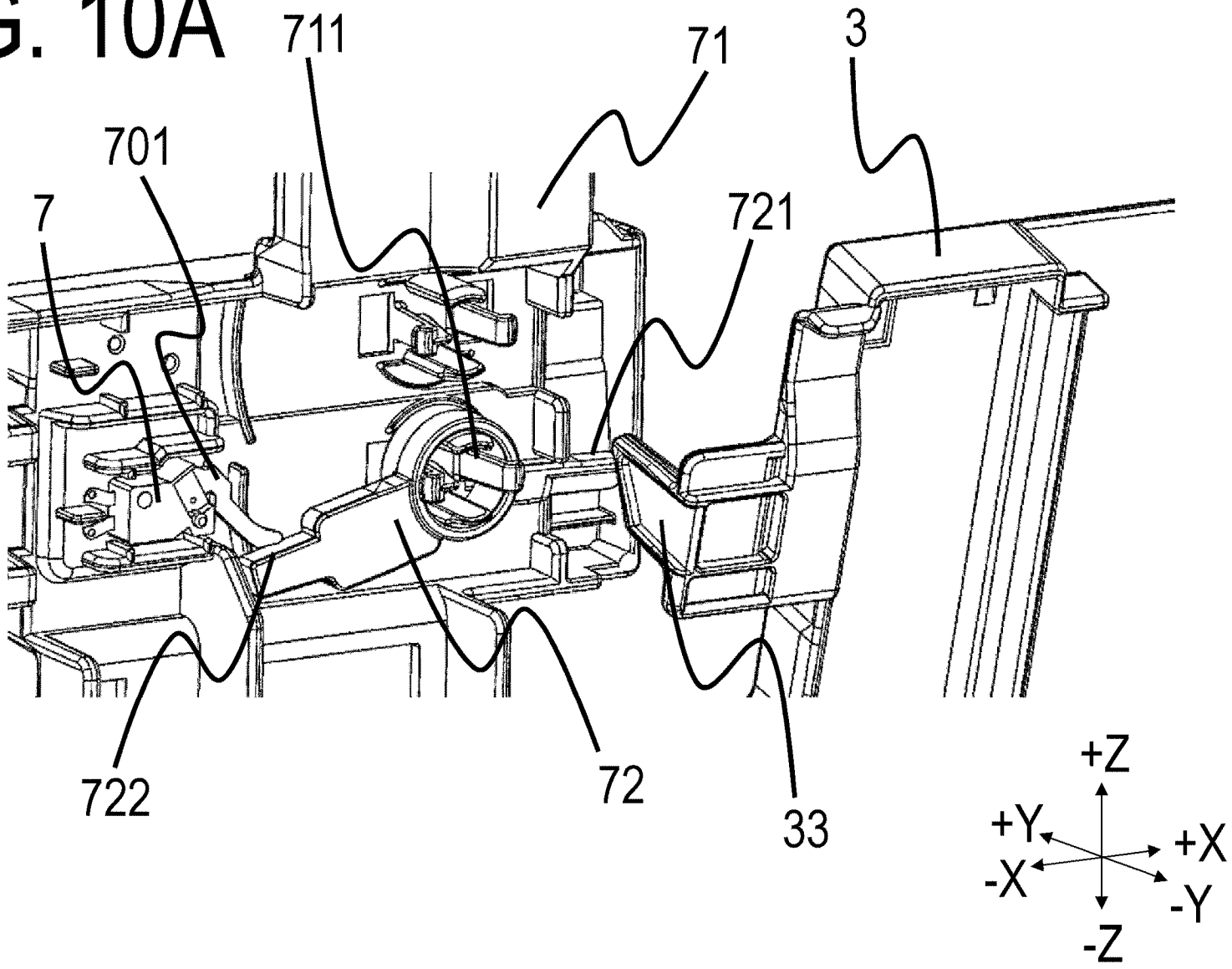
FIGS. 10A and 10B are schematic perspective views showing the opening and closing detection mechanism of the paper discharge tray of the fourth embodiment.
Figure 10B:
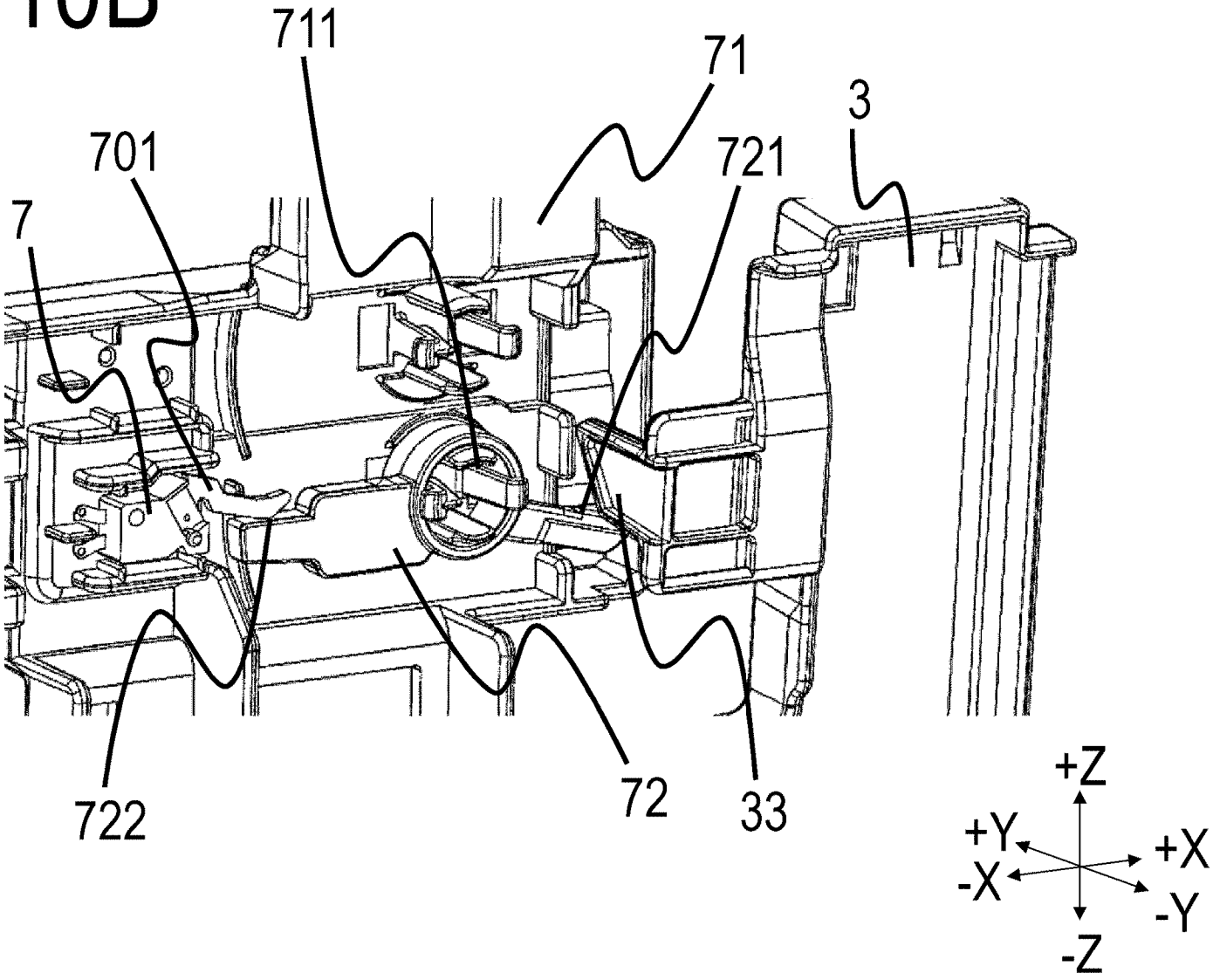

FIG. 9 is an enlarged front view of an extracted opening and closing detection configuration of the paper discharge tray 3. FIGS. 10A and 10B are enlarged perspective views of the extracted opening and closing detection configuration of the paper discharge tray 3.

The opening and closing detection mechanism of the paper discharge tray 3 may be a detection configuration including an opening and closing detection member 7, which is a lever switch 7 in the present embodiment, a detection portion holding component 71, a lever component 72 rotationally held by the detection portion holding component 71, and a sensor flag portion 33 included in the paper discharge tray 3.

The sensor flag portion 33 protrudes from the paper discharge tray 3 in the closing direction. The lever component 72 as a lever member is rotationally supported by the unit housing of the lever switch 7 through a lever component holding portion 711. The lever component 72 has a sensor flag contact surface 721 and a movable portion contact surface 722. The lever switch 7 has a movable portion 701. When the paper discharge tray 3 reaches the closed position, the sensor flag portion 33 of the paper discharge tray 3 abuts the sensor flag contact surface 721 of the lever component 72. This rotates the lever component 72 and thus causes the movable portion contact surface 722 to abut on the movable portion 701, thereby displacing the movable portion 701. This displacement of the movable portion 701 allows the lever switch 7 to output the closed state of the paper discharge tray 3.

As shown in FIGS. 10A and 10B, as the sensor flag portion 33 of the paper discharge tray 3 moves toward the closed state (first orientation), the sensor flag contact surface 721 of the lever component 72 is pressed down. The rotated lever component 72 moves the lever switch 7, allowing for the detection of opening and closing of the paper discharge tray 3.

Figure 11:
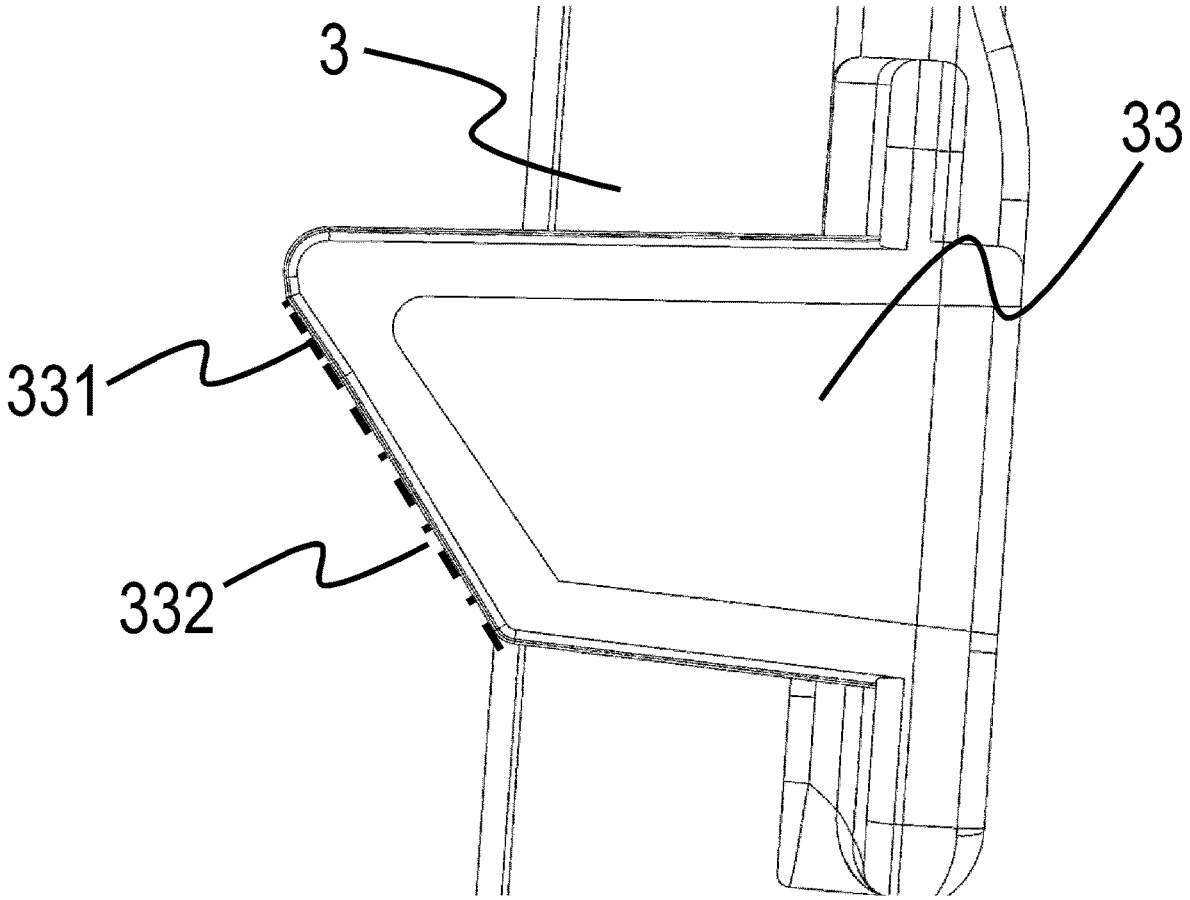
FIG. 11 is an enlarged side view showing a sensor flag portion of the paper discharge tray of the fourth embodiment.

FIG. 11 is an enlarged side view of the sensor flag portion 33 of the opening and closing detection configuration. The sensor flag portion 33 has a contact surface on its lower side that faces toward the axis of the rotation shaft 32. The contact surface comes into contact with the sensor flag contact surface 721 of the lever component 72. The contact surface includes slopes 331 and 332, which are inclined with respect to the circumferential direction about the axis of the rotation shaft 32 such that the contact surface is closer to the axis of the rotation shaft 32 toward the proximal end from the distal end of the sensor flag portion 33.

To reduce the possibility that the paper discharge tray 3 that is being pulled toward the first orientation is stopped by the reaction force of the lever switch 7 before it is fully pulled, the opening and closing detection mechanism of the present embodiment is configured as follows. When the surface of the sensor flag portion 33 that comes into contact with the lever component 72 has a smaller angle with respect to the horizontal direction, the paper discharge tray 3 is less likely to be stopped by the reaction force while being pulled. However, this requires the sensor flag portion 33 to be extended toward the housing so as to sufficiently press down the lever component 72. With a configuration in which the access cover 4 and the paper discharge tray 3 are located on the same side as in the apparatus configuration of the present embodiment, the movable range of the recording head described above is often located in the vicinity of the paper discharge tray 3 when the paper discharge tray 3 is closed. Accordingly, extending the sensor flag portion 33 toward the housing 1 requires a larger housing size. In this respect, the present embodiment is configured so that the sensor flag portion 33 has the first slope 331 indicated by the broken line in FIG. 11 and the second slope 332 indicated by the dashed dotted line. The first slope 331 of this configuration has a smaller angle with respect to the circumferential direction about the axis of the rotation shaft 32, resulting in a smaller entry angle toward the horizontal direction (first inclination angle). This facilitates the pulling of the distal end portion of the sensor flag portion 33, which is most likely to be affected by the switch reaction force during pulling. In contrast, the second slope 332 has a larger angle with respect to the circumferential direction about the axis of the rotation shaft 32 than the first slope 331 (second inclination angle), so that the lever component 72 is sufficiently pressed down even if the length of the sensor flag portion 33 toward the housing 1 is short. That is, the stable pulling and the detection of opening and closing of the paper discharge tray 3 can be achieved without increasing the size of the housing.

The configurations of the embodiments described above may be combined to the extent that does not cause technical contradiction. In the above embodiments, the toggle urging mechanism of the tension spring 5 is provided for the paper discharge tray 3, but the application of this toggle urging mechanism is not limited to the paper discharge tray 3. For example, it may be provided for the paper feed tray 2 as the second tray. In this case, the tension spring 5 may be provided not only between the paper feed tray 2 and the housing 1, but also between the paper feed tray 2 and the paper discharge tray 3 and between the paper feed tray 2 and the access cover 4. Furthermore, the toggle urging mechanism may be provided between the access cover 4 and the housing 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-118807, filed on Jul. 19, 2021, which is hereby incorporated by reference herein in its entirety.

What is claimed is:

1. A recording apparatus comprising:

a housing configured to house a recording portion recording an image on a sheet and to have a side including an opening through which the sheet passes;

a tray configured to rotate about a rotation shaft, relative to the housing, between a closed position at a first angle for closing the opening and an open position at a second angle for loading the sheet, and an urging mechanism configured to urge the tray toward the closed position in a case where an angle about the rotation shaft of the tray is between the first angle and a third angle and to urge the tray toward the open position in a case where an angle about the rotation shaft of the tray is between the third angle and the second angle, wherein the third angle is an angle between the first angle and the second angle.

2. The recording apparatus according to claim 1, wherein the urging mechanism includes a tension spring coupling the housing to the tray such that a tensile force acts on the tray to rotate the tray, and wherein the tension spring is provided such that the tensile force does not act in a direction for rotating the tray in a case where the tray is at the third angle.

3. The recording apparatus according to claim 2, wherein the tension spring is located outward of the rotation shaft in an axial direction of the rotation shaft, and one end of the tension spring is held by the housing and the other end is held by the tray such that the tension spring is displaced across the axis in a case where the tray rotates between the first angle and the second angle.

4. The recording apparatus according to claim, 2 further comprising:

an opening and closing member that is located inward of the tray in the housing and configured to be rotatable relative to the housing and take a closed position for closing the opening and an open position for opening the opening, wherein the tension spring is located outward of the rotation shaft in an axial direction of the rotation shaft, and one end of the tension spring is held by the opening and closing member and the other end is held by the tray such that the tension spring is displaced across the axis in a case where the tray rotates between the first angle and the second angle.

5. The recording apparatus according to claim 4, wherein the opening and closing member is an access cover for exposing the recording portion to an outside through the opening.

6. The recording apparatus according to claim 2, wherein the third angle is an angle at which a weight of the tray and the tensile force of the tension spring are balanced.

7. The recording apparatus according to claim 1, wherein the third angle is an angle that allows the sheet discharged from the recording portion to be loaded on the tray.

8. The recording apparatus according to claim 2, wherein the tensile force of the tension spring has a magnitude that allows the tray to rotate toward the open position in a case where the tray receives a force from the sheet discharged from the recording portion at the third angle.

9. The recording apparatus according to claim 1, wherein the tray is held in the closed position by an urging force of the urging mechanism.

10. The recording apparatus according to claim 1, wherein the tray is a discharge tray for loading the sheet discharged from the recording portion through the opening.

11. The recording apparatus according to claim 1, further comprising a second tray that is located outward of the tray in the housing and configured to be rotatable relative to the housing and take a closed position for closing the opening and an open position for loading the sheet.

12. The recording apparatus according to claim 11, wherein the second tray is a feed tray for loading the sheet to be fed to the recording portion through the opening.

13. The recording apparatus according to claim 1, wherein the tray is a feed tray for loading the sheet to be fed to the recording portion through the opening.

14. The recording apparatus according to claim 11, wherein the tray has a rotation stop portion that abuts on the second tray in the open position such that sheet loading space on the second tray is secured between the tray and the second tray, and wherein in a case where the tray is in the open position, an urging force of the urging mechanism holds the rotation stop portion in abutment with the second tray.

15. The recording apparatus according to claim 1, further comprising:

a detection mechanism for detecting whether the tray is in the closed position, wherein the detection mechanism includes:

a flag portion provided on the tray so as to protrude in a direction in which the tray moves from the open position to the closed position;

a lever member that is provided on the housing and configured to come into contact with the flag portion so as to be displaced toward an axis of the rotation shaft; and a detection portion that detects displacement of the lever member to detect that the tray is in the closed position, wherein the flag portion has a contact surface that faces toward the axis of the rotation shaft and that comes into contact with the lever member, and wherein the contact surface includes a slope that is inclined with respect to a circumferential direction about the axis of the rotation shaft such that the contact surface is closer to the axis toward a proximal end from a distal end of the flag portion.

16. The recording apparatus according to claim 15, wherein the slope includes:

a first slope that is inclined at a first inclination angle with respect to the circumferential direction; and a second slope at the proximal end that is proximal to the first slope and inclined at a second inclination angle that is greater than the first inclination angle with respect to the circumferential direction.

* * * * *